US006187518B1

(12) United States Patent
Jones et al.

(10) Patent No.: US 6,187,518 B1
(45) Date of Patent: Feb. 13, 2001

(54) BACKING LAYERS WITH REDUCED SCUM FORMATION FOR PHOTOGRAPHIC FILMS

(75) Inventors: Raymond T. Jones, Webster; Ravi Sharma, Fairport; Alfred B. Fant, Rochester, all of NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/178,171

(22) Filed: Oct. 23, 1998

(51) Int. Cl.[7] ..... G03C 1/795; G03C 1/85; G03C 1/77; G03C 1/79; G03C 1/93

(52) U.S. Cl. ..... 430/393; 430/434; 430/444; 430/510; 430/512; 430/525; 430/527; 430/523; 430/531; 430/533; 430/534; 430/536; 430/537; 430/930

(58) Field of Search ..... 430/523, 531, 430/534, 537, 930, 510, 512, 536, 533, 525, 527, 393, 434, 444

(56) References Cited

U.S. PATENT DOCUMENTS

| | | | | |
|---|---|---|---|---|
| 2,313,570 | * | 3/1943 | Nadeau et al. | 430/531 |
| 2,334,215 | * | 11/1943 | Nadeau et al. | 430/531 |
| 2,875,056 | * | 2/1959 | Smith et al. | 430/537 |
| 5,514,528 | * | 5/1996 | Chen et al. | 430/531 |
| 5,770,353 | * | 6/1998 | Wang et al. | 430/537 |
| 5,786,134 | * | 7/1998 | Nair et al. | 430/527 |
| 5,962,207 | * | 10/1999 | Anderson et al. | 430/531 |

* cited by examiner

*Primary Examiner*—Richard L. Schilling
(74) *Attorney, Agent, or Firm*—Doreen M. Wells; Carl F. Ruoff

(57) ABSTRACT

The present invention is a photographic element which includes a support, at least one silver halide emulsion superposed on a front side of the support and an outermost backing layer superposed on a backside of the support. The outermost backing layer is composed of a hydrophobic binder and a hydrophilic binder wherein the backing layer has an advancing water contact angle of 70 or greater and a receding water contact angle of at least 40 less than the advancing water contact angle.

21 Claims, No Drawings

BACKING LAYERS WITH REDUCED SCUM FORMATION FOR PHOTOGRAPHIC FILMS

FIELD OF THE INVENTION

This invention relates to a backing system for photographic elements. More particularly, the present invention provides a backing layer for photographic film that has less of a propensity to allow the formation of scum on the side opposite the emulsion coated side of photographic film after processing.

BACKGROUND OF THE INVENTION

It is customary to include backing layers on the side of a photographic element opposite to the light sensitive layers. Typical properties of such layers include antistatic protection, magnetic recordation, light absorbtion and lubrication. When these features are included in the backing layers, the binder used to contain the functional component may be a hydrophilic binder, such as, gelatin, or a hydrophobic binder, such as a cellulosic material. When hydrophilic materials are used, these layers may become tacky under high humidity conditions and matting agents or backing paper are required to prevent sticking in the wound state. Matting agents on the back may add to the non-uniformity seen in prints, commonly called graininess, and backing paper adds thickness to the wound roll, precluding their use in cassettes.

However, when hydrophobic materials are used as the binder, residue may adhere to the backing after photographic processing, commonly called scum, which may show in the photographic print.

The present invention provides a backing layer that exhibits a lack of high humidity tackiness and a lack of scum deposition after photographic processing.

SUMMARY OF THE INVENTION

The present invention is a photographic element which includes a support, at least one silver halide emulsion superposed on a front side of the support and an outermost backing layer superposed on a backside of the support. The outermost backing layer is composed of a hydrophobic binder and a hydrophilic binder wherein the backing layer has an advancing water contact angle of 70 or greater and a receding water contact angle of at least 40 less than the advancing water contact angle.

DETAILED DESCRIPTION OF THE INVENTION

Photographic elements which can be provided with the backing system in accordance with this invention can differ widely in structure and composition. For example, they can vary greatly in regard to the type of support, the number and composition of the image-forming layers, and the kinds of auxiliary layers that are included in the elements. In particular, the photographic element can be still films, motion picture films, x-ray films, graphic arts films, paper prints or microfiche. They can be black or white elements, color elements adapted for use in a negative-positive process, or color elements adapted for use in a reversal process.

Photographic elements can comprise any of a wide variety of supports. Typical supports include cellulose nitrate film, cellulose acetate film, poly(vinyl acetal) film, polystyrene film, poly(ethylene terephthalate) film, poly(ethylene naphthalate) film, polycarbonate film, glass, metal, paper, polymer coated paper, and the like. The support can be annealed if desired.

The image forming layer or layers of the photographic element typically include a radiation-sensitive agent, e.g., silver halide, dispersed in a hydrophilic water-permeable colloid. Suitable hydrophilic vehicles include both naturally-occurring substances such as proteins, for example, gelatin, gelatin derivatives, cellulose derivatives, polysaccharides such as dextran, gum arabic, and the like and synthetic polymeric substances such as water-soluble polyvinyl compounds like poly(vinylpyrrolidone), acrylamide polymers, and the like. A particularly common example of an image-forming layer is a gelatin-silver halide emulsion layer. Further details can be found in Research Disclosure Number 389, September 1996.

The photographic element of the present invention can contain an electrically conductive layer, which can be a sub layer. The surface resistivity of at least one side of the support is preferably less than $1\times10^{12}$ Ω/square, more preferably less than $1\times10^{11}$ Ω/square at 25° C. and 20 percent relative humidity. To lower the surface resistivity, a preferred method is to incorporate at least one type of electrically conductive material in the electrically conductive layer. Such materials include both conductive metal oxides and conductive polymers or oligomeric compounds. Such materials have been described in detail in, for example, U.S. Pat. Nos. 4,203,769; 4,237,194; 4,272,616; 4,542,095; 4,582,781; 4,610,955; 4,916,011; and 5,340,676.

The outermost backing layer in accordance with this invention may be positioned over a transparent magnetic recording layer as described in U.S. Pat. Nos. 5,395,743; 5,397,826; 5,113,903; 5,432,050; 5,434,037; and 5,436,120.

The present invention is also directed to a single-use camera having incorporated therein a photographic material as described above. Single-use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic materials are exposed in camera, and then the product is sent to the developer who removes the photographic material and develop it. Return of the single-use camera to the consumer does not normally occur, however, the photographic material will be returned.

The photographic processing steps to which the film may be subject may include, but are not, limited to the following:

(1) color developing→bleach-fixing→washing/stabilizing;

(2) color developing→bleaching→fixing→washing/stabilizing;

(3) color developing→bleaching bleach→fixing→washing/stabilizing;

(4) color developing→stopping→washing→bleaching→washing→fixing→washing/stabilizing;

(5) color developing→bleach-fixing→fixing→washing/stabilizing;

(6) color developing→bleaching→bleach-fixing→fixing→washing/stabilizing.

Among the processing steps indicated above, the steps (1), (2), (3), and (4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP 559,026; U.S. Pat. Nos. 5,313,243; 5,339,131.

Single-use cameras and their methods of manufacture and use are described in U.S. Pat. Nos. 4,801,957; 4,901,097; 4,866,459; 4,849,325; 4,751,536; 4,827,298; European Patent Applications 460,400; 533,785; 537,225; all of which are incorporated herein by reference.

The outermost backing layer useful in the practice of the invention may optionally contain antistatic agents, charge control agents, ultraviolet ray absorbers, processing removable dyes, colloidal inorganic particles, magnetic recording particles, and various other additives.

The backing layer useful in the practice of the invention can be applied by any of a number of well-known techniques, such as dip coating, rod coating, blade coating, air knife coating, gravure coating and reverse roll coating, extrusion coating, slide coating, curtain coating, and the like. After coating, the backing layer is generally dried by simple evaporation, which may be accelerated by known techniques such as convection heating. Known coating and drying methods are described in further detail in Research Disclosure No. 308119, Published December 1989, pages 1007 to 1008.

The terms hydrophilic and hydrophobic as used herein are relative. Hydrophilic materials exhibit good water solubility, typically being soluble in water at a concentration of at least 0.2 grams per milliliter, while hydrophobic materials exhibit poor water solubility, typically being soluble in water at a concentration of no more than about 0.01 grams per milliliter.

The hydrophobic/hydrophilic layer for minimizing scum after photographic processing is coated on the side opposite the side the image-forming layer are coated and must be the outermost layer. Hydrophobic binders include cellulose esters, branched cellulose esters, fluorinated cellulose esters, long chain alkyl and fluoroalkyl esters. Hydrophilic binders are selected from the group of polymers containing quaternary ammonium salts such as polyvinyl benzyl chloride, gelatin, polyelectrolyte polymers such as poly styrene sulfonate. Hence, it can be coated over the support itself or over other backing layers, such as antistat, antihalation, charge control, curl control layers, etc. The preferred coating compositions of these scum control layers are 0.75/0.25/0.5 weight percent cellulose acetate 398-3, 40–60 sec. cellulose nitrate, and polymer A or 0.75/0.25/0.5 weight percent cellulose acetate 398-3, 40–60 sec. cellulose nitrate, and polymer B in a 98.5 weight percent solvent mixture of 50/50 acetone/methanol. Polymer A is a 50/25/25 mole percent terpolymer of ethylacrylate/acrylic acid/N,N-dimethyl acrylamide. Polymer B is latex beads of vinylbenzyl chloride quaternized with trimethyl amine crosslinked with ethylene glycol dimethacrylate. The coating vehicle for this layer is solvent. Suitable solvents include ketones, such as, acetone, methylethyl ketone, diethyl ketone, dibutyl ketone and the like, alcohols, such as methanol, ethanol, n-propanol, isopropanol, n-butanol, isobutanol, tert-butanol and the like. The preferred solvents are acetone and methanol. The hydrophobic binder:hydrophilic binder ratio is from 2:1 to 1:3. The scum control layer is applied at a coverage of 10 to 100 mg/ft$^2$, preferably 20 to 50 mg/ft$^2$.

EXAMPLES

Table 1 lists the percentages of the mixtrues of hydrophobic/hydrophilic polymers that were coated from 50/50 acetone/methanol, the scum evaluations of these coating that were C-41 processed without going through the stabilizer bath but subsequently immersed for 90 seconds in Stabilizer 3 that had been doctored with calcium chloride to 300 ppm Ca and the advancing water contact angles and the difference between the advancing and receding water contact angles of these coatings. These coatings were made with a #8 wire wound rod on raw acetate support to obtain a coverage of approximately 38 mg/ft$^2$.

TABLE 1

Scum and Contact Angle Results

| % CA398-3 | % CN | % Hydrophilic | Scum After C-41 w/no Stab. 3 + ppm Ca 300 | After C-41 C.A.* Water Adv. | After C-41 C.A.* Water Adv.-Rec. |
|---|---|---|---|---|---|
| | | Polymer A | | | |
| 0.75 | 0.25 | 0 | Heavy | 63 | 26 |
| 0.75 | 0.25 | 0.1 | None | 77 | 45 |
| 0.75 | 0.25 | 0.3 | None | 76 | 40 |
| 0.75 | 0.25 | 0.5 | None | 80 | 51 |
| | | Polymer B | | | |
| 0.75 | 0.25 | 0 | Moderate | 66 | 33 |
| 0.75 | 0.25 | 0.1 | Slight | 62 | 36 |
| 0.75 | 0.25 | 0.3 | Slight | 65 | 44 |
| 0.75 | 0.25 | 0.5 | None | 70 | 48 |

Hydrophilic Polymer A = 50/25/25 mole % terpolymer of ethyl acrylate, acrylic acid and N,N-dimethyl acrylamide.
Hydrophilic Polymer B = crosslinked latex beads of vinyl benzyl chloride quaternized with trimethyl amine and crosslinked with ethylene glycol dimethacrylate.
*C.A. = Contact Angle The data show that as the hydrophilic content (acrylic terpolymer or quaternized polymer) of the polymer blends increases the propensity to scum in the doctored stabilizer decreases. The data also show that the coatings with no scum have an advancing contact angle greater than 70 and an advancing minus receding contact angle difference of greater than 40 while the coatings that do scum do not have these contact angle properties.

Table 2 lists the scum and contact angle results of three commercially available films. The data show that each of the films have scum and do not meet the criteria of an advancing water contact angle of 70 or greater and a difference of advancing minus receding water contact angles of 40 or greater.

TABLE 2

Scum and Contact Angle (C.A.) Results

| Films | Scum After C-41 w/no Stab. and w/Stab. 3 + ppm Ca 300 | After C-41 C.A. Water Adv. | After C-41 C.A. Water Adv.-Rec. |
|---|---|---|---|
| A | Heavy | 62 | 25 |
| F | Heavy | 61 | 29 |
| K | Moderate | 71 | 37 |

The invention has been described in detail with particular reference to certain preferred embodiments thereof, but it will be understood that variations and modifications can be effected within the spirit and scope of the invention.

What is claimed is:

1. A photographic element comprising:

a support having a front side and a backside;

at least one silver halide emulsion superposed on the front side of said support; and an outermost backing layer superposed on the backside of said support comprising at least one hydrophobic binder blended with at least one hydrophilic binder, wherein the outermost backing layer has an advancing water contact angle of 70 or greater and a receding water contact angle of at least 40 less than the advancing water contact angle, and wherein at least one hydrophilic binder is selected from the group consisting of polymers containing quaternary ammonium salts and polyelectrolyte polymers.

2. The photographic element of claim 1, wherein the support is selected from the group consisting of cellulose nitrate film, cellulose acetate film, poly(vinyl acetal) film, polystyrene film, poly(ethylene terephthalate) film, poly (ethylene naphthalate) film, polycarbonate film, glass, metal and paper.

3. The photographic element of claim 1, further comprising an antistatic layer superposed on the backside of the support.

4. The photographic element of claim 1, further comprising a magnetic layer superposed on the backside of the support.

5. The photographic element of claim 1, wherein at least one hydrophobic binder is selected from the group consisting of cellulose esters, branched cellulose esters, fluorinated cellulose esters, long chain alkyl and fluoroalkyl esters.

6. The photographic element of claim 1, wherein a hydrophobic binder:hydrophilic binder ratio is from 2:1 to 1:3.

7. The photographic element of claim 1, wherein the outermost backing layer further comprises antistatic agents, charge control agents, ultraviolet ray absorbers, processing removable dyes, colloidal inorganic particles or magnetic recording particles.

8. A photographic element according to claim 1, wherein said at least one hydrophilic binder is a terpolymer of ethylacrylate, acrylic acid, and N,N-dimethyl acrylamide.

9. A photographic element according to claim 1, wherein said at least one hydrophilic binder is vinylbenzyl chloride quaternized with trimethyl amine crosslinked with ethylene glycol dimethacrylate.

10. A photographic element according to claim 1, wherein said at least one hydrophobic binder is cellulose acetate or cellulose nitrate.

11. A photographic element according to claim 8, wherein said at least one hydrophobic binder is cellulose acetate or cellulose nitrate.

12. A photographic element according to claim 9, wherein said at least one hydrophobic binder is cellulose acetate or cellulose nitrate.

13. A photographic element according to claim 10, wherein the ratio of hydrophobic binder to hydrophilic binder is from 2:1 to 1:3.

14. A method of reducing scum formation on a photographic element during processing comprising subjecting a photographic element according to claim 1 to at least one photographic processing step.

15. A method according to claim 14, wherein the photographic element is subjected to the photographic processing steps of color developing, bleach-fixing, and washing/stabilizing.

16. A method according to claim 14, wherein the photographic element is subjected to the photographic processing steps of color developing, bleaching, fixing, and washing/stabilizing.

17. A method according to claim 14, wherein the photographic element is subjected to the photographic processing steps of color developing, bleaching, bleach-fixing, and washing/stabilizing.

18. A method according to claim 14, wherein the photographic element is subjected to the photographic processing steps of color developing, stopping, washing, bleaching, washing, fixing, and washing/stabilizing.

19. A method according to claim 14, wherein the photographic element is subjected to the photographic processing steps of color developing, bleach-fixing, fixing and washing/stabilizing.

20. A method according to claim 14, wherein the photographic element is subjected to the photographic processing steps of color developing, bleaching, bleach-fixing, fixing and washing/stabilizing.

21. A photographic element comprising:

a support having a front side and a backside;

at least one silver halide emulsion superposed on the front side of said support; and an outermost backing layer superposed on the backside of said support comprising at least one hydrophobic binder blended with at least one hydrophilic binder that is not gelatin, wherein the outermost backing layer has an advancing water contact angle of 70 or greater and a receding water contact angle of at least 40 less than the advancing water contact angle.

* * * * *